US008562040B2

(12) United States Patent
Scheffler et al.

(10) Patent No.: US 8,562,040 B2
(45) Date of Patent: Oct. 22, 2013

(54) ELECTROMECHANICAL LOCKING DEVICE INTENDED FOR REMOTE ACCESS CONTROL

(75) Inventors: Dominik Scheffler, Phoenix, AZ (US); Michael Webb, Phoenix, AZ (US); Joshua Peabody, Phoenix, AZ (US); Ryan Sims, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 4 days.

(21) Appl. No.: 13/013,877

(22) Filed: Jan. 26, 2011

(65) Prior Publication Data

US 2011/0163556 A1 Jul. 7, 2011

Related U.S. Application Data

(63) Continuation of application No. 11/226,509, filed on Sep. 14, 2005, now Pat. No. 7,878,560.

(60) Provisional application No. 60/611,813, filed on Sep. 20, 2004.

(51) Int. Cl.
*E05B 9/00* (2006.01)

(52) U.S. Cl.
USPC ..... 292/337; 292/216; 292/201; 292/203; 292/DIG. 23

(58) Field of Classification Search
USPC ..... 292/216, 201, DIG. 23, 194, 203, 304
See application file for complete search history.

(56) References Cited

U.S. PATENT DOCUMENTS

| | | | | | |
|---|---|---|---|---|---|
| 4,978,153 | A | * | 12/1990 | Hirsch et al. | 292/201 |
| 5,438,855 | A | | 8/1995 | Ikeda | |
| 5,758,912 | A | | 6/1998 | Hamada | |
| 5,979,951 | A | * | 11/1999 | Shimura | 292/216 |
| 6,050,117 | A | | 4/2000 | Weyerstall | |
| 6,076,868 | A | * | 6/2000 | Roger et al. | 292/201 |
| 6,089,626 | A | * | 7/2000 | Shoemaker | 292/216 |
| 6,199,938 | B1 | | 3/2001 | Choi | |
| 6,386,599 | B1 | * | 5/2002 | Chevalier | 292/201 |
| 6,419,286 | B1 | * | 7/2002 | Szablewski | 292/216 |
| 6,439,623 | B1 | * | 8/2002 | Lohfeld et al. | 292/201 |
| 6,520,550 | B2 | * | 2/2003 | Kunst et al. | 292/216 |
| 6,550,825 | B2 | * | 4/2003 | Ostrowski et al. | 292/199 |
| 6,557,911 | B2 | * | 5/2003 | Nelsen et al. | 292/216 |
| 6,698,805 | B2 | | 3/2004 | Erices et al. | |
| 6,719,333 | B2 | * | 4/2004 | Rice et al. | 292/216 |

(Continued)

FOREIGN PATENT DOCUMENTS

| | | | |
|---|---|---|---|
| EP | 0130726 | | 1/1985 |
| EP | 130726 | A1 * | 1/1985 |

*Primary Examiner* — Carlos Lugo
*Assistant Examiner* — Mark Williams
(74) *Attorney, Agent, or Firm* — Woods Oviatt Gilman LLP

(57) ABSTRACT

An electric lock for remote access control to a container wherein a U-shaped latch is mounted on a door in alignment with a slot in a housing mounted in the container. Upon closure, the latch enters the housing to engage a slotted keeper therein and causes rotation of the keeper. Rotation of the keeper causes a release lever to engage a stepped protrusion on the keeper and secures the keeper and latch. Activation of a solenoid or drive motor coupled to the release lever permits withdrawal of the latch from the housing. The axes of rotation of the keeper and release lever are located to greatly reduce the impact of pre-release forces to the door.

14 Claims, 4 Drawing Sheets

(56) References Cited

U.S. PATENT DOCUMENTS

| | | | | |
|---|---|---|---|---|
| 6,848,727 | B1 * | 2/2005 | Cetnar et al. | 292/201 |
| 6,932,393 | B2 * | 8/2005 | Erices | 292/216 |
| 6,964,438 | B2 | 11/2005 | Koike et al. | |
| 6,974,165 | B2 * | 12/2005 | Koike et al. | 292/216 |
| 6,988,749 | B2 * | 1/2006 | Hashiba et al. | 292/201 |
| 7,111,877 | B2 | 9/2006 | Larsen et al. | |
| 2004/0227359 | A1 * | 11/2004 | Coleman et al. | 292/254 |

* cited by examiner

UNLOCKED

LOCKED

UNLOCKED

LOCKED

ELECTROMECHANICAL LOCKING DEVICE INTENDED FOR REMOTE ACCESS CONTROL

CROSS-REFERENCE TO RELATED APPLICATIONS

This application is a continuation of U.S. patent application Ser. No. 11/226,509, filed Sep. 14, 2005 now U.S. Pat. No. 7,878,560, which claims the benefit of U.S. Provisional Application No. 60/611,813, filed Sep. 20, 2004.

FIELD OF THE INVENTION

This invention relates to a durable electric locking device that is particularly well-suited for applications wherein access to a container is to be controlled. The subject invention is a keyless locking device that releases a latch when a low voltage (e.g., 12V or 24V dc) is applied. In case of a power failure, the device is fail secure to prevent unauthorized access during the occurrence of unpredictable events. Typical applications include gates, lockers, closets, cabinets and like storage facilities wherein access is controlled from a central location.

BACKGROUND OF THE INVENTION

A feature of this type of remotely controlled locking device is the ability to overcome the application of a pre-release load by the user. Frequently, the user applies some force to the gate or door before the release mechanism receives an unlock signal. The application of the pre-release load can prevent the unlocking from taking place, thereby introducing unreliability in the system. In contrast, the device described herein is capable of releasing the gate or door with a pre-release load applied.

Accordingly, the present invention is directed to a rugged locking device wherein the mechanical elements contained in a source housing operate to permit access under pre-release load conditions. The locking of the device occurs when the door latch enters the housing and engages a mating keeper that is mechanically secured therein by structural elements that are not accessible to those attempting to defeat the locking device.

BRIEF SUMMARY OF THE INVENTION

The subject locking device includes a durable housing for mounting within the container in a location proximate to the door. One side thereof includes a removable cover. The opposing side is bolted or welded to the interior surface of the storage facility in a position of alignment to receive a latch mounted on the door. The housing contains an opening facing the door to receive the latch upon closure.

The latch configuration is typically U-shaped with the ends of the latch being secured to a disk that is mounted by a slotted clasp on the door. The base of the latch enters the opening in the housing and is guided and located by the walls of a slot to engage a keeper mounted therein.

The keeper contains an angled receiving slot having a receiving section and a locking section. The receiving section of the keeper is positioned in alignment with the opening when the keeper is in the first or unlocked position. Upon insertion, the latch enters the receiving section and contacts the wall of the locking section and urges the keeper to rotate to a second or locked position. The keeper rotates due to the force applied by the latch to the wall of the slot and moves in the space intermediate the opposing sides of the U-shaped latch. The forward or linear movement of the latch is translated into rotational movement of the keeper. When the keeper and slot reach the second position, a detent on a retaining release lever in the housing contacts a stepped protrusion on the keeper and the device is locked.

The release lever is rotationally mounted in the housing with one end adapted for receipt of the keeper and the opposing end operatively coupled to an electromechanical driver. The driver is electrically connected to an access control system which enables the operator to release the U-shaped latch when the proper user credential is verified by the system. The keeper is provided with a biasing means which returns the keeper to the unlatched position each time the door is opened. The withdrawal of the latch then places the keeper in the first position. The biasing means maintains the position of the keeper for the next closure of the door.

Should a power failure occur, the U-shaped latch can be captured by the locking device but it will not be released until power is supplied to the electromechanical driver. The driver is a solenoid coupled to the release lever. Alternatively, the electromechanical driver may comprise an electric motor which drives a step-down gear to rotate the release lever and free the keeper to return to the unlocked position.

The subject locking device is an effective electric locking device utilizing a novel interaction of the operative element to enable unlocking to take place during the application of a pre-release load. The device is a durable structure mounted within the container to limit access to authorized users. Further features and advantages will become more readily apparent from the following description when taken in conjunction with the accompanying drawings.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
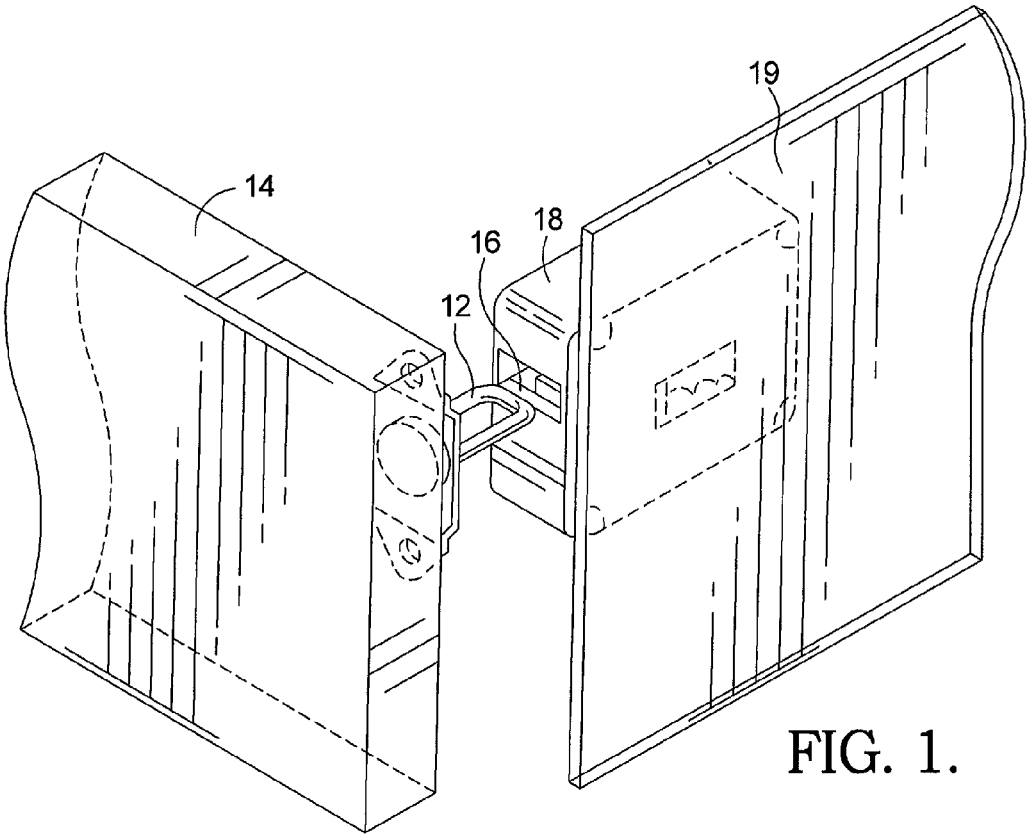
FIG. 1 is a perspective view of the invention showing the latch and housing installed.

Referring now to the drawings, FIG. 1 shows the subject electric locking device as comprising a latch 12 mounted on cabinet door 14 in general alignment with opening 16 in housing 18. The housing 18 is mounted to the interior surface of cabinet wall 19. In the case of metal compartments, one sidewall of the housing may be welded to the interior wall of the cabinet. The opposing sidewall is attached to the body of the housing by threaded fasteners.

Figure 2:
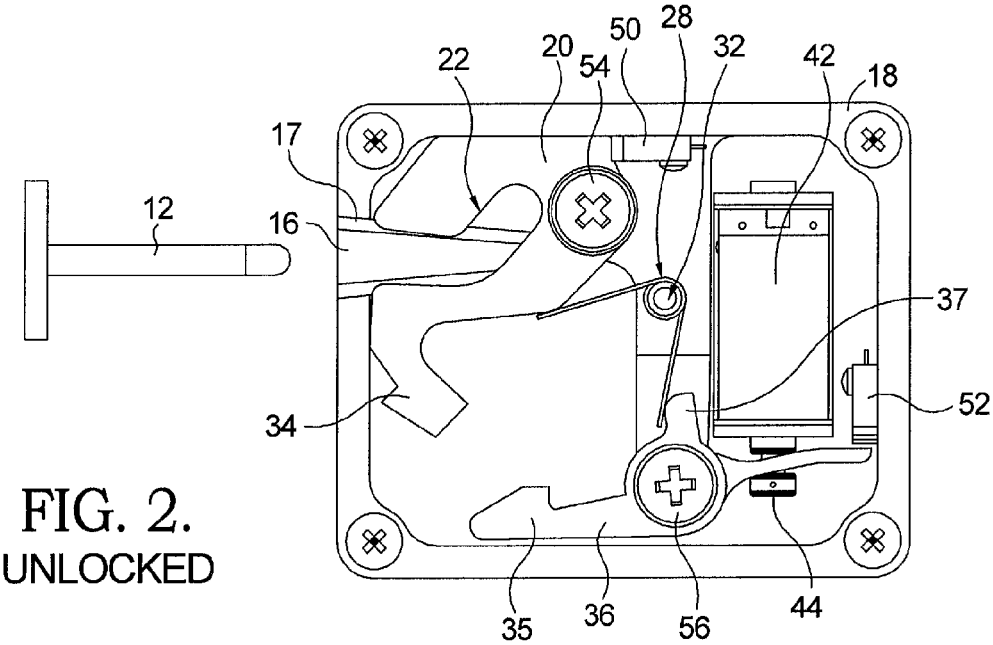
FIG. 2 is a side view of the preferred embodiment showing the housing with the cover removed and the keeper in the first or unlocked position.
Figure 3:
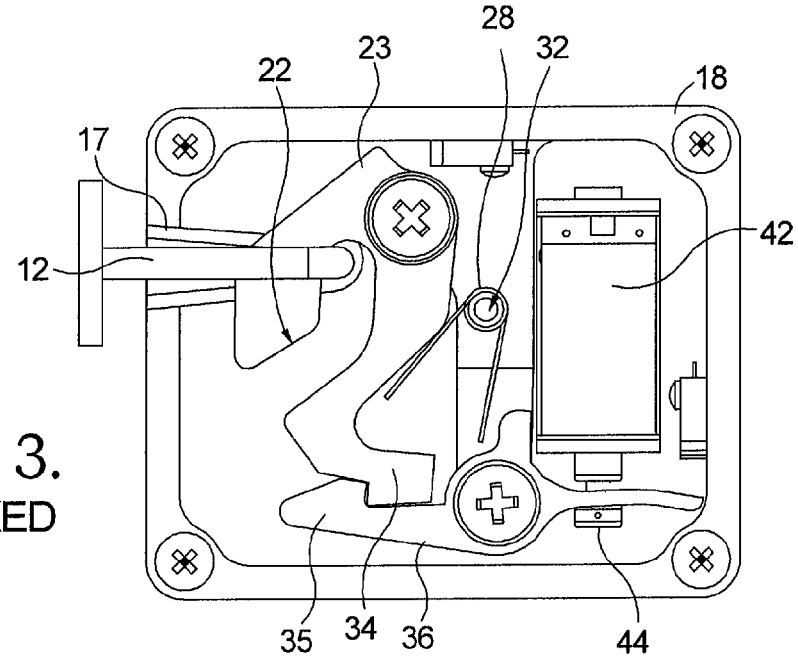
FIG. 3 is a side view of FIG. 2 with the keeper in the second or locked position.

In FIG. 2, the side view of the housing of the locking device shows the locking mechanism in the unlocked position with latch 12 about to enter the housing through slot 16. As shown, the slot is bounded by inwardly tapered walls 17 which guide the latch in the slot as the cabinet door is being closed. FIG. 3, shows the locking mechanism in the locked position with the latch 12 fully engaged by the keeper and secured in the housing.

The housing 18 includes the tapered slot 16 to ensure consistent proper location of the U-shaped latch into the angled slot 22 of the keeper 20 upon insertion of the latch. The end of the tapered slot 16 is located proximate to the rotational point of the keeper 20, defined by shoulder screw 54, to reduce the effects of a pre-load force without compromising the ability of the keeper 20 to rotate freely when the latch 12 is inserted.

The housing 18 contains rotatably mounted keeper 20 having an angled slot 22 extending inwardly to receive latch 12. The innermost or locking section of the slot is angle upwardly for approximately half of the length of the slot. In the unlocked position, the receiving portion of the slot is aligned with the opening in the housing. The housing 18 establishes the end position for the keeper 20 in the unlocked position, as shown in FIG. 2. In the embodiment shown, the keeper rotates through an angle of 38° to the locked position shown in FIG. 3. The latch 12 entering the housing engages the walls of slot 22 as it moves therethrough and urges the keeper to rotate through the U-shaped latch to the locked position.

A biasing torsion spring 28 secured to pin 32 in the housing maintains the keeper in the unlocked position shown in FIG. 2 until force from the latch 12 causes rotation thereof. The entry of latch 12 into the housing causes rotation of the keeper to the locked position as limited by a detent on the release lever 36 as seen in FIG. 3. The state of the keeper and the release lever of the electric locking device can be provided to a central station by the use of optional microswitches 50 and 52 affixed to the housing and positioned as shown in FIG. 2.

The keeper is provided with a stepped protrusion 34 formed in the lower arm and extending downwardly from the slot 22. A release lever 36 is rotatably mounted in the housing on shoulder screw 56 and biased to contact the stepped protrusion of the keeper by a force applied via torsion spring 28 to a radial arm. In the locked position, the detent 35 located at the first end of the lever 36 is engaged by the protrusion 34 of the keeper.

In the preferred embodiment, a solenoid 42 having a plunger 44 is mounted in the housing. The removable sidewall (not shown) is provided with an electrical port for connection to the access control system. As shown, the plunger extends through an opening in the adjacent second end of the release lever. The torsion spring 28 contacts the radial arm 37 of lever 36 and urges the detent end of the release lever upwardly toward the keeper as shown in FIG. 3. The solenoid is preferably a low voltage DC responsive solenoid that is coupled to an external control panel. Plunger 44 has a section of reduced diameter to receive the slotted end of lever 36. The application of the electrical signal to the solenoid causes the plunger 44 to retract and overcomes the force of torsion spring 28 thereby withdrawing the release lever to the position shown in FIG. 2. As a result, the keeper 20 rotates due to the force provided by torsion spring 28. The latch 12 is then released and can be withdrawn. The presence of a typical release force on the latch by the user does not interfere with the ability of the present locking device to return to the unlocked position. The principles behind this performance are detailed as shown in the force diagrams of FIGS. 4 and 5.

The position of the U-shaped latch 12 in relation to the axis of rotation of the keeper is chosen so that the lever arm R pre-load is minimized. The second requirement for this positioning is that the lever arm R pre-load has to be long enough to allow a rotation of the keeper into the locked position at a certain insertion force of the latch. These two requirements define the position of the latch as guided in movement by the tapered slot.

Figure 4:
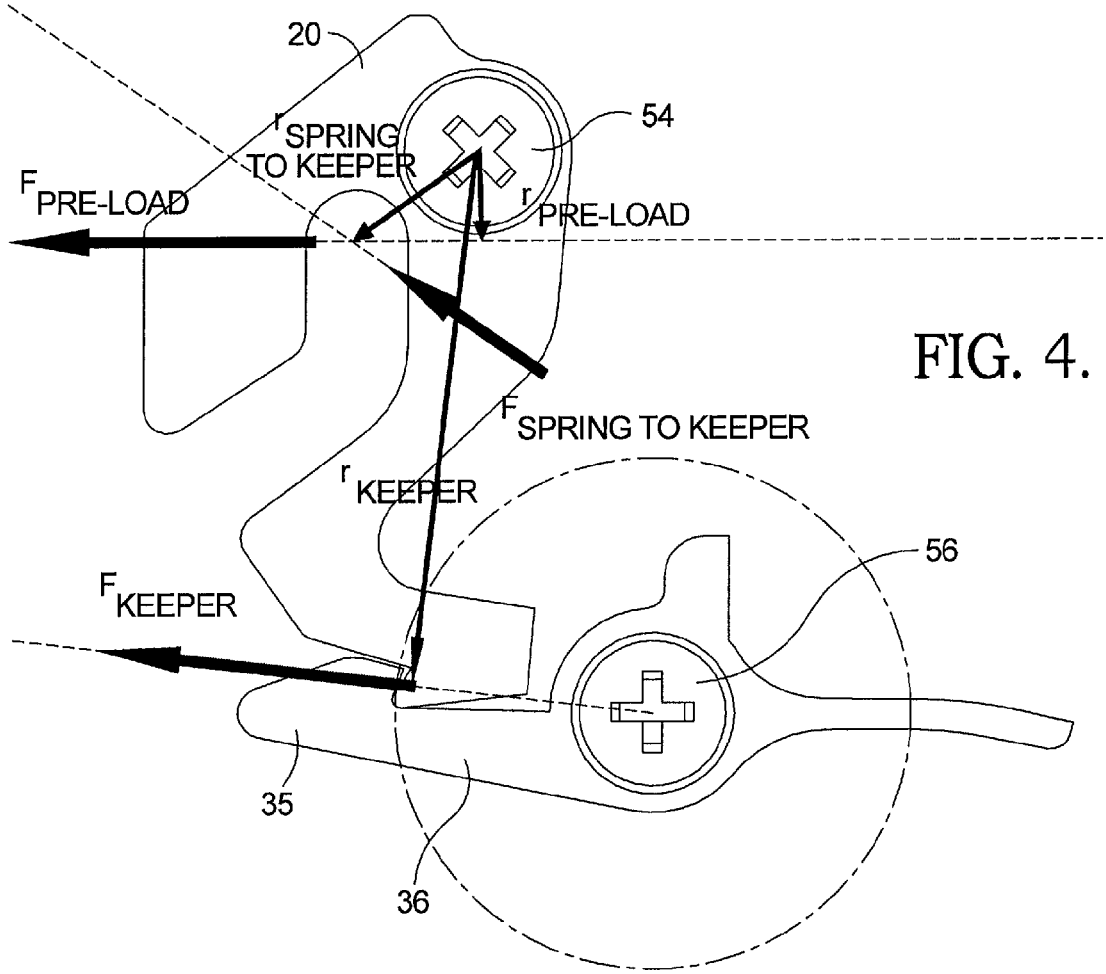
FIG. 4 is a diagram showing the forces and leverages that result in moments causing the rotational movement of the keeper.
Figure 5:
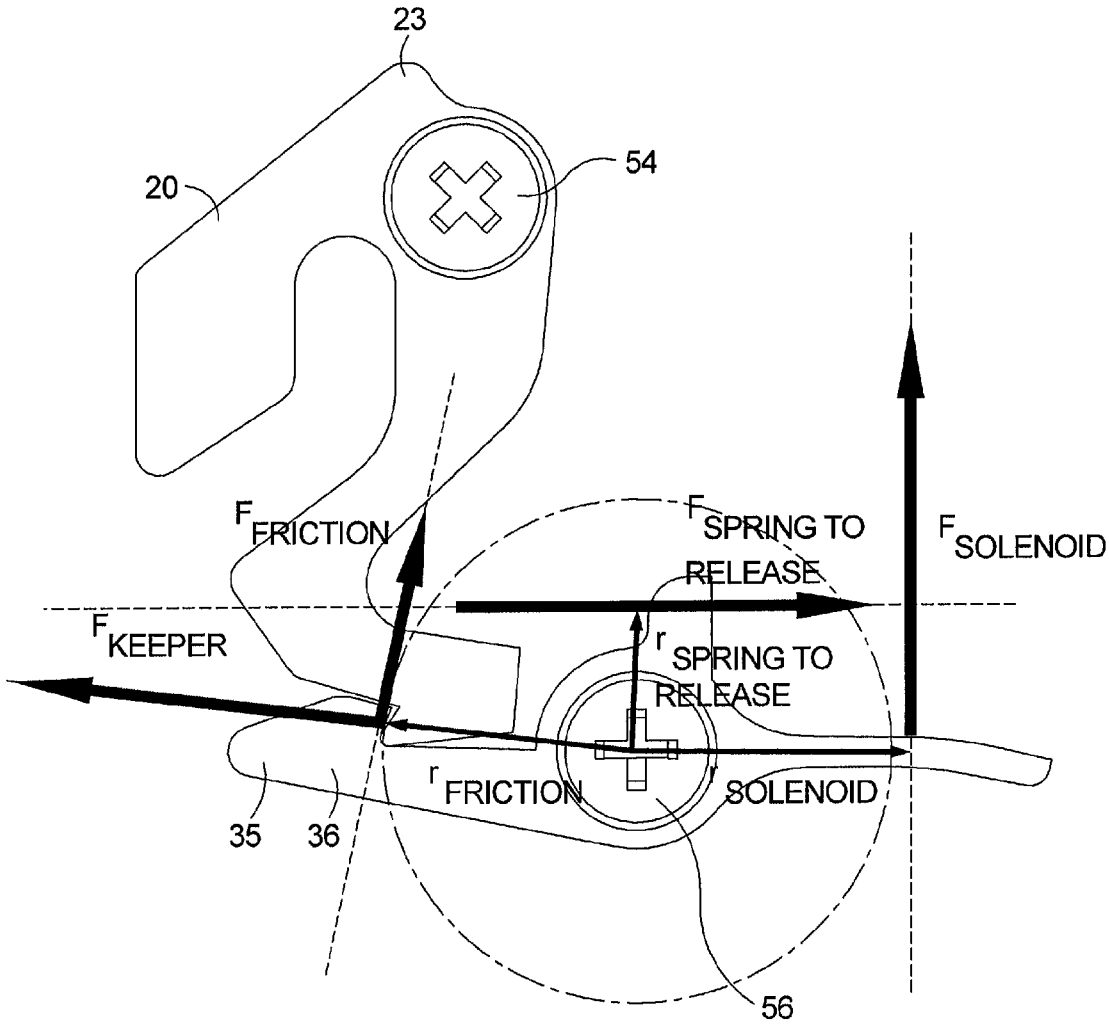
FIG. 5 is a diagram showing the forces and leverages that result in the moments causing the rotational movement of the release lever.

The arc of the detent 35 on the release lever is concentric to the rotational axis of the release lever as shown in FIG. 4. Therefore, the direction of force F keeper which consists of the force F pre-load applied by the U-shaped latch and the force F spring 2 translated through the keeper, is directed through the rotational axis of the release lever. Therefore, the leverage arm R release equals 0 (see principle II) and the application of a pre-release load does not defeat the unlocking action of the solenoid. This results in zero moment on the release lever caused by the load on the keeper as shown in FIG. 5. The moment of the solenoid must be greater than the moment of the friction forces plus the moment of the spring to overcome the pre-load as set forth in the Formula Requirement to unlock Electric Locking Device. Hence, the capability to release the latch by the electric locking device when exposed to pre-opening force is increased and only influenced by frictional forces between the keeper and the release lever. The effect of the friction forces is decreased by the reduction of the coefficient of friction $\mu_s$ (See Principle III). If $\mu_s$ and lever arm R release are reduced to 0, the only requirement to unlock the locking device is that the moment of the release lever created by the spring be made smaller than the moment created by the solenoid as set forth in the Requirement to Unlock Electric Locking Device.

The relationships of the moments to the present invention shown in FIGS. 4 and 5 are expressed as follows:

$$\Sigma M_{Keepernd}=0$$

$$M_{Keeper}F_{pre\text{-}load}r_{pre\text{-}load}+F_{spring\ 1}r_{spring\ 1}+(-F_{keeper}r_{keeper}\rightarrow A)=0$$

$$\rightarrow F_{spring\ 1}r_{keeper}\rightarrow A=F_{pre\text{-}load}r_{pre\text{-}load}+F_{spring\ 1}r_{spring\ 1}$$

Optimization of Pre-Load Capability Principle I:

$$R_{pre\text{-}load}\rightarrow \text{Min}$$

$$\rightarrow_{Mpre\text{-}load}\rightarrow \text{Min}$$

$$\Sigma M_{release\text{-}lever}=0$$

$$M_{release\text{-}lever}=F_{keeper}r_{release}\rightarrow_{A}=F_{friction}r_{friction}=F_{spring2}r_{spring2}$$

$$\rightarrow F_{solenoid}r_{solenoid}=F_{keeper}\rightarrow_{A}=F_{friction}r_{friction}=F_{spring2}r_{spring2}$$

Optimization of Pre-Load capability Principle II:

$$r_{Release}\rightarrow_{A}\rightarrow 0$$

$$\rightarrow M_{keeper}\rightarrow 0$$

Optimization of Pre-Load Capability Principle III:

$$F_{friction}=F_{keeper}\mu_s$$

$$\mu_s\rightarrow 0$$

$$\rightarrow F_{friction}\rightarrow 0$$

$$\rightarrow M_{friction}\rightarrow 0$$

Requirement to Unlock Electric Locking Device:

$$F_{solenoid}r_{solenoid} > F_{keeper}r_{release\rightarrow A} + F_{friction}r_{friction} + F_{spring2}r_{spring2} \rightarrow F_{solenoid} > \frac{F_{keeper}r_{release\rightarrow A} + F_{friction}r_{friction} + F_{spring2}r_{spring2}}{r_{solenoid}}$$

if Principle II and Principle III are met, the requirement to unlock the Electric Locking Device reduces to:

$$F_{solenoid} > \frac{F_{spring2}r_{spring2}}{r_{solenoid}}$$

Figure 6:
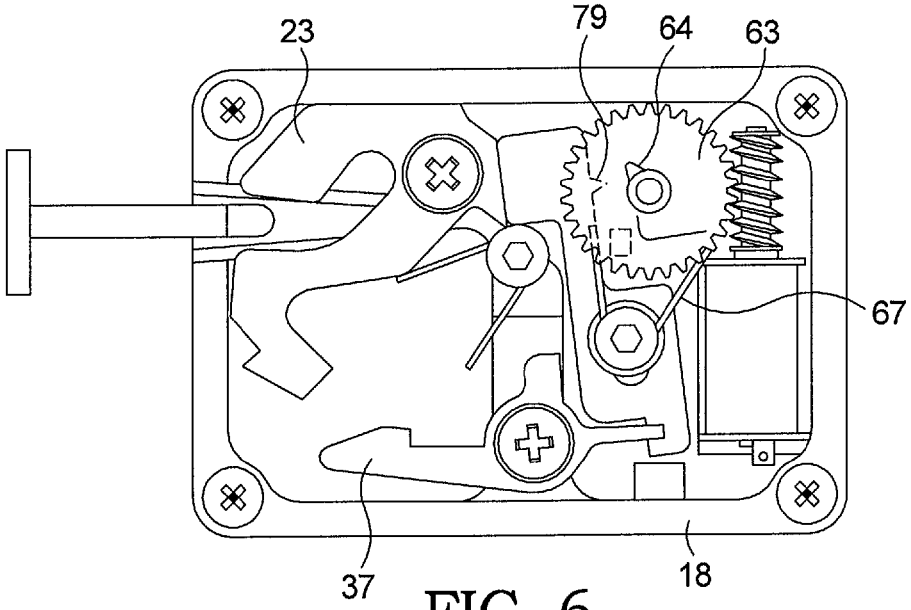
FIG. 6 is a side view of a second embodiment of the invention with the keeper in the first or unlocked position.
Figure 7:
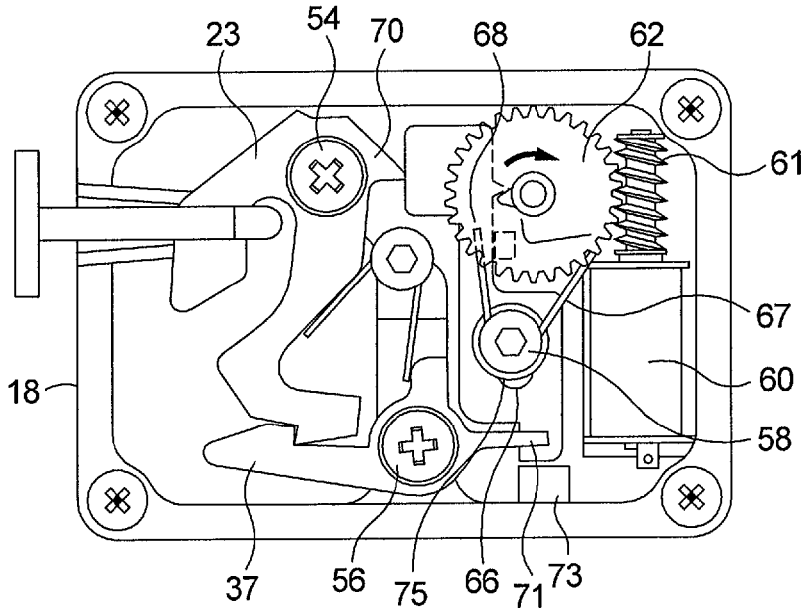
FIG. 7 is a side view of FIG. 6 with the keeper in the second or locked position.

The afore-described embodiment utilizes a low power solenoid as the electromechanical driver to overcome the force of the spring and unlock the subject invention. An alternative drive mechanism for the locking device is shown in the embodiment of FIGS. 6 and 7. The electromechanical driver mounted in the housing 18 includes a DC motor 60 having a worm-gear shaft 61 that engages an adjacent reduction gear 62. The reduction gear 62 has a single gear tooth 64. The rotational movement of the motor drive shaft is axially shifted to be used by sliding rack 66. The sliding rack is provided with a biasing spring 67 which is centered at fastener 58 and has the free ends thereof in contact with motor 60 and boss 68 on the rack as shown.

The keeper 23 in the embodiment of FIGS. 6 and 7 is similar to keeper 20 of FIGS. 2 and 3 with the exception of angled protrusion 70 which contacts the rack. Release lever 37 is similar to lever 36 of FIGS. 2 and 3 with the exception that the free end resides in slot 71 of the rack rather than engaging a solenoid plunger. The spring biasing of keeper and release lever remains the same in both embodiments. In both embodiments, the force from the latch hook rotates the keeper which enters into engagement with the detent on the release lever as seen in FIG. 7 to attain the locked position.

In reaching the locked position, the release lever detent receives the keeper end and rotates to the position of FIG. 7 wherein the free end of the lever urges the sliding rack downwardly to contact stop 73 formed as part of the housing wall. To achieve the unlocked position, the received signal activates the drive motor 60 which causes single gear tooth 64 to rotate, contact the adjacent single projection 79 on the sliding rack 66 and import both linear and rotational movement to the rack along the length of slot 75. The sliding rack is movably mounted in the housing by fastener 58 extending through the slot.

The activation of the drive motor causes the sliding rack to move linearly thereby rotating the release lever 37 and freeing the keeper from the detent. Rotation of the keeper to the position of FIG. 6 permits the biasing spring to rotate the sliding rack with the result that single projection 79 on the rack is spaced from the single gear tooth 64 and remains in this state until the latch is inserted and drives the keeper into the retained contact state of the locked position of FIG. 7. At that point, the angled protrusion 70 of the keeper urges rotation of the sliding rack and repositions the gear tooth for the next open lock signal from the central station. The two embodiments discussed herein utilize the same axes of rotation for keeper and release lever along with substantially similar keeper and release lever geometries. As a result, the operation of the present electric locking devices is essentially independent of the application of pre-release loads applied by the user in advance of the signal from the central control station.

While the above description has referred to specific embodiments of the invention, it is to be noted that modifications and variations may be made therein without departing from the scope of the invention as claimed.

It will be obvious to those skilled in the art to make various changes, alterations and modifications to the invention described herein. To the extent such changes, alterations and modifications do not depart from the spirit and scope of the appended claims, they are intended to be encompassed therein.

The invention claimed is:

1. A locking device for receiving a latch having a locked and unlocked position, said device comprising:

(a) a housing configured for receiving said latch therein;

(b) a keeper having a receiving slot for releasably engaging said latch, said keeper further including an engagement feature;

(c) a releasing lever rotationally disposed about an axis, said releasing lever including an arc shaped surface that is concentric to the rotational axis of said releasing lever; and (d) an actuator coupled to the releasing lever, said actuator configured for selectively permitting rotation of said keeper to the unlocked position, wherein said engagement feature engages said arc shaped surface in the locked position, wherein engagement of said engagement feature and said arc shaped surface inhibits said keeper upon receipt of said latch in said receiving slot thereby establishing the locked position, and wherein said arc shaped surface is configured for enabling said locking device to assume the unlocked position by an activation of said actuator when a pre-release load is applied to said keeper by said latch.

2. The locking device in accordance with claim 1 wherein said actuator includes a driver and wherein said driver is electrically actuated.

3. The locking device in accordance with claim 2 wherein said driver is a solenoid mounted in said housing, said solenoid having a plunger coupled to said releasing lever.

4. The locking device in accordance with claim 1 wherein said keeper contacts said housing when in the unlocked position to establish a limit of rotation.

5. The locking device in accordance with claim 1 wherein an opening is defined in said housing, and wherein said receiving slot is aligned with said opening in the unlocked position.

6. The locking device in accordance with claim 5 further comprising a biasing member urging said keeper to align said receiving slot with said opening.

7. A locking device for receiving a latch having a locked and unlocked position, said device comprising:

(a) a housing configured for receiving said latch therein, wherein an opening is defined in said housing;

(b) a keeper having a receiving slot for releasably engaging said latch, wherein said receiving slot is aligned with said opening in the unlocked position, said keeper further including an engagement feature;

(c) a releasing lever rotationally disposed about an axis, said releasing lever including an arc shaped surface that is concentric to the rotational axis of said releasing lever;

(d) a biasing member comprising a single spring having a first end and a second end, said first end engaging said keeper for urging said keeper to align the receiving slot with said opening, said second end engaging said releasing lever for urging said releasing lever into engagement with said keeper; and (e) an actuator coupled to the releasing lever, said actuator configured for selectively permitting rotation of said keeper to the unlocked position, wherein said engagement feature engages said arc shaped surface in the locked position, and wherein engagement of said engagement feature and said arc shaped surface inhibits said keeper upon receipt of said latch in said receiving slot thereby establishing the locked position.

8. The locking device in accordance with claim 5 wherein said opening is defined by tapered sidewalls in said housing to guide movement of the latch therein.

9. The locking device in accordance with claim 1 wherein said receiving slot includes a receiving section and a locking section.

10. The locking device in accordance with claim 9 wherein said receiving section and said locking section are of approximately equal length.

11. The locking device in accordance with claim 1 wherein said keeper rotates about 40 degrees about an axis of rotation.

12. The locking device in accordance with claim 1 wherein said latch is U-shaped with said keeper rotating therethrough to the locked position.

13. The locking device in accordance with claim 12 further comprising at least one microswitch mounted on said housing for contact by said keeper to indicate the state of the locking device.

14. The locking device in accordance with claim 12 further comprising at least one microswitch mounted on said housing for contact by said release lever to indicate the state of the locking device.

* * * * *